US010804634B2

(12) United States Patent
Betz

(10) Patent No.: US 10,804,634 B2
(45) Date of Patent: Oct. 13, 2020

(54) ELECTRONIC CONTACT

(71) Applicant: WALTER SOEHNER GMBH & CO. KG, Schwaigern (DE)

(72) Inventor: Thomas Betz, Schwaigern (DE)

(73) Assignee: WALTER SOEHNER GMBH & CO. KG, Schwaigern (DE)

( * ) Notice: Subject to any disclaimer, the term of this patent is extended or adjusted under 35 U.S.C. 154(b) by 0 days.

(21) Appl. No.: 16/383,267

(22) Filed: Apr. 12, 2019

(65) Prior Publication Data

US 2019/0237893 A1 Aug. 1, 2019

Related U.S. Application Data

(63) Continuation of application No. PCT/EP2017/072047, filed on Sep. 4, 2017.

(30) Foreign Application Priority Data

Oct. 14, 2016 (DE) ..... 10 2016 119 611

(51) Int. Cl.

| | |
|---|---|
| ***H01R 13/11*** | (2006.01) |
| ***H01R 12/70*** | (2011.01) |
| ***H01R 43/16*** | (2006.01) |
| ***H01R 12/55*** | (2011.01) |
| ***H01R 12/58*** | (2011.01) |

(52) U.S. Cl.

CPC ..... *H01R 13/113* (2013.01); *H01R 12/55* (2013.01); *H01R 12/585* (2013.01); *H01R 12/7088* (2013.01); *H01R 43/16* (2013.01)

(58) Field of Classification Search

CPC ..... H01R 12/2442

USPC ..... 439/857, 856, 947

See application file for complete search history.

(56) References Cited

U.S. PATENT DOCUMENTS

| | | | | |
|---|---|---|---|---|
| 6,080,008 | A * | 6/2000 | Frantz | H01R 4/4881 439/441 |
| 6,210,240 | B1 * | 4/2001 | Comerci | H01R 12/7088 439/853 |
| 6,814,598 | B2 | 11/2004 | Hoffmann et al. | |
| 9,545,001 | B2 * | 1/2017 | Goto | H05K 1/11 |
| 2004/0097140 | A1 | 5/2004 | Hoffmann et al. | |
| 2005/0176267 | A1 | 8/2005 | Saitoh | |
| 2005/0250356 | A1 | 11/2005 | Matsumura et al. | |

(Continued)

FOREIGN PATENT DOCUMENTS

| | | |
|---|---|---|
| CN | 200956439 Y | 10/2007 |
| CN | 203644985 U | 6/2014 |

(Continued)

OTHER PUBLICATIONS

International Search Report corresponding to PCT/EP2017/072047, dated Jan. 12, 2017, 7 pages.

*Primary Examiner* — Phuong K Dinh
(74) *Attorney, Agent, or Firm* — Reising Ethington P.C.

(57) ABSTRACT

A contact device having at least one connection contact, a contact clamping apparatus, and a contact reception apparatus, wherein the contact reception apparatus is designed as a substantially rectangular contact plate into which a contact recess is introduced, a side plate having connection contacts is arranged on at least one side of the contact plate, and the contact clamping apparatus is designed as a clamping element that is arranged on at least one further side of the contact plate.

9 Claims, 6 Drawing Sheets

(56) References Cited

U.S. PATENT DOCUMENTS

| | | | |
|---|---|---|---|
| 2007/0167037 | A1 | 7/2007 | Thiel et al. |
| 2009/0023310 | A1 | 1/2009 | Thiel et al. |
| 2011/0043345 | A1 | 2/2011 | Strahm et al. |
| 2012/0115339 | A1 | 5/2012 | Schaarschmidt et al. |

FOREIGN PATENT DOCUMENTS

| | | | |
|---|---|---|---|
| DE | 20203083 | U1 | 5/2002 |
| DE | 102005021568 | A1 | 12/2005 |
| DE | 202009010426 | U1 | 11/2009 |
| DE | 102009025113 | A1 | 12/2010 |
| EP | 1341264 | A2 | 9/2003 |
| WO | WO2005079127 | A1 | 8/2005 |
| WO | WO2005096447 | A1 | 10/2005 |
| WO | WO2018068946 | A1 | 4/2018 |

* cited by examiner

ELECTRONIC CONTACT

CROSS-REFERENCE TO RELATED APPLICATIONS

This application is a continuation of co-pending International Application No. PCT/EP2017/072047, filed on Sep. 4, 2017 designating the U.S. and published in German language on Apr. 19, 2018. The international application claims priority of German patent application DE 10 2016 119 611.8, filed on Oct. 14, 2016. All of the aforementioned applications are incorporated herein by reference in their entirety.

BACKGROUND OF THE INVENTION

The invention relates to a contact device having at least a connection contact, a contact clamping apparatus, and a contact reception apparatus.

The invention furthermore relates to a circuit board connection device having such a contact device and a plug contact, wherein the plug contact is guided through the contact reception apparatus and held in the contact clamping apparatus and the connection contacts are to be connected to a circuit board element. The invention furthermore relates to a method for producing a contact device.

Contact devices are known from DE 20 2009 010 426 U1. Connection contacts having struts, contact surfaces and contact plates are formed from a metal foil. The struts are bent such that the contact plates elastically form a contact reception apparatus. At least one connection contact is connected to the struts. A plug contact may be inserted into the contact reception apparatus. The connection contact allows a connection to a circuit board.

Devices designed in numerous variants are tried and tested. However, their production costs are extremely high. In order to ensure elasticity, the material thickness needs to be kept as thin as possible. Their high-current application is thereby restricted.

WO 2005 079 127 A1 discloses an electrical assembly having an electrically conductive contact pin to be pressed into an aperture of a circuit board. The aperture of the circuit board has predefined dimensions and the contact pin has a defined excess at least in a partial region in order to form a press connection. The inserted length of the contact pin is greater than the depth of the circuit board aperture. The inserted contact pin sits on the circuit board by way of an edge region and makes contact, in the press-in region, with the contact zone situated there, this preferably being cold-welded in a gastight manner and, on the opposite side, flood-welded to the contact zone there.

As described in WO 2005 096 447 A1, US 2005 0176 267 A1, DE 10 2009 025 113 A1 and DE 10 2005 021 568 A1, the connection to a circuit board is produced by way of a press-in pin.

SUMMARY

According to at least some embodiments, advantages of the invention are achieved both in the case of a circuit board connection device and the case of a contact reception apparatus in that the contact reception apparatus is designed as a substantially rectangular contact plate into which a contact recess is introduced, a side plate having connection contacts is arranged on at least one side of the contact plate, and the contact clamping apparatus is designed as a clamping element that is arranged on at least one further side of the contact plate.

The advantages connected with this are in particular that electronic contacts are able to be formed from a flat lead-frame using few bending or folding procedures. The simple design of the connection recess in the rectangular contact plate, the folding and forming of the side plates having the connection contacts and of the clamping elements therefor quite significantly simplifies the production procedure. The thickness of the metal foil and therefore the magnitude of the current to be channeled may furthermore be increased.

There may be arranged, on a narrow side of the contact plate, a side plate having connection contacts, and, on the opposing narrow side of the contact plate, a further side plate having further connection contacts. Both side plates are therefore folded upward with their connection contacts and delimit the connection recess. The connection recess may be tailored to the shape of the plug contact and have various geometric shapes. One of these shapes may be that of a rectangle. The side plates may be folded at various angles in relation to the contact plate. One of these angles may be 90°. These right angles ensure a good transmission of force when the connection contacts are connected. The clamping contacts may be arranged on the opposing longitudinal sides of the contact plate. They are inclined toward the connection recess and thus ensure good and secure contact with the plug-in contact.

The contact plate, the side plates having the connection contacts and the clamping contacts may be produced from a metal sheet, from an electrically conductive material, in particular copper, brass, aluminum, CuNiSi or the like, with a thickness of between 0.4 and 1.5 mm and more.

Up until now, metal sheets having a thickness of 0.4 to 1.2 mm were used in electronic contacts produced in the prior art. The significantly easier production makes it possible to increase the metal sheet thickness. The metal sheet thickness has now been increased to 1.5 mm. It is also possible to increase the metal sheet thickness even more. A thickness of up to 2.5 mm is targeted, that is to say double the thickness of 1.2 mm previously able to be processed. As a result, high-current application is quite significantly improved.

The contact plate, the side plates having the connection contacts and/or the clamping contacts may be at least partly enclosed by a housing.

The housing may be produced from plastic or the like.

The clamping contacts may be designed differently.

First clamping contacts may be designed so as to be substantially S-shaped. They allow easy insertion of the connection contact and make it more difficult to pull same out.

Second clamping contacts may be designed so as to be substantially S-shaped. They allow both easy insertion of the connection contact and easy pulling out of same. This gives an easily detachable connection.

The connection contacts may be designed as press-in contacts, solder contacts or the like.

The embodiment that is used depends on the specific conditions of use.

It is understood that the features mentioned above and the features yet to be discussed below may be used not only in the respectively specified combination but also in other combinations or individually without departing from the scope of the present invention.

BRIEF DESCRIPTION OF THE DRAWINGS

Further advantages and configurations of the invention result from the description and the appended drawing. Here, in the figures.

DETAILED DESCRIPTION OF PREFERRED EMBODIMENTS

Figure 1:
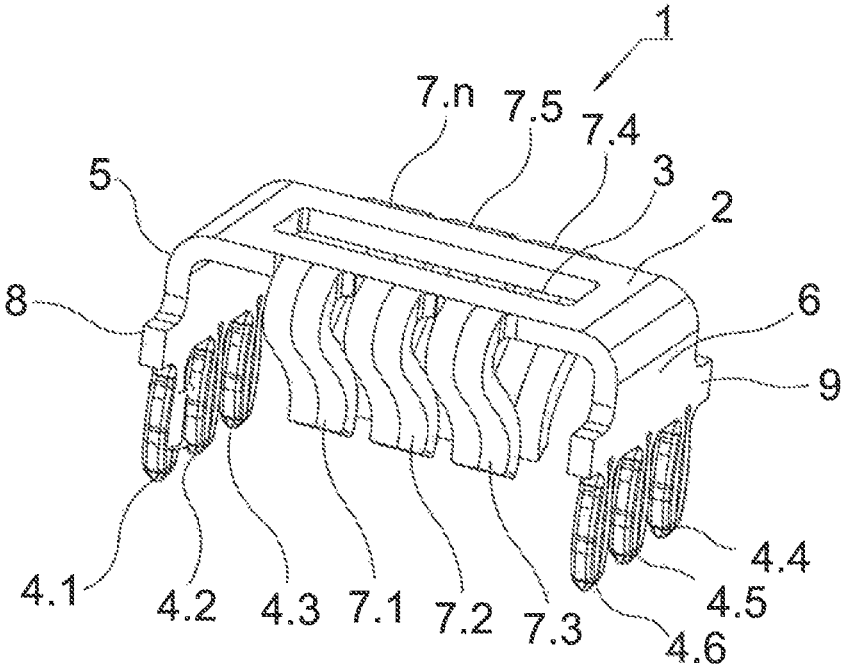
FIG. 1 shows an exemplary embodiment of an electronic contact in a first embodiment in a schematic, perspective illustration seen from above.
Figure 3A:
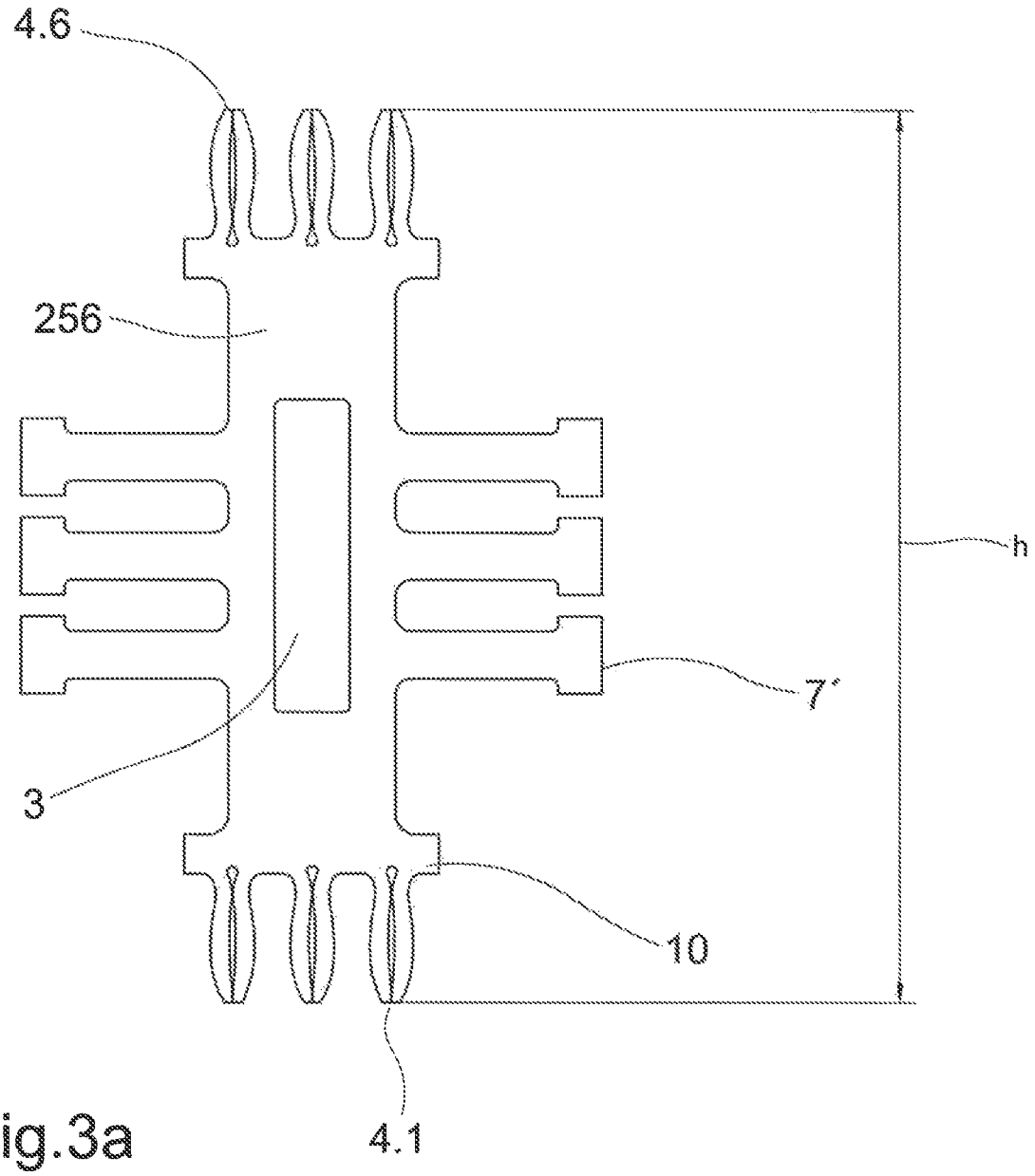
FIG. 3*a* shows a leadframe for producing an electronic contact according to FIG. 1 in a schematically illustrated plan view in actual size.
Figure 3B:
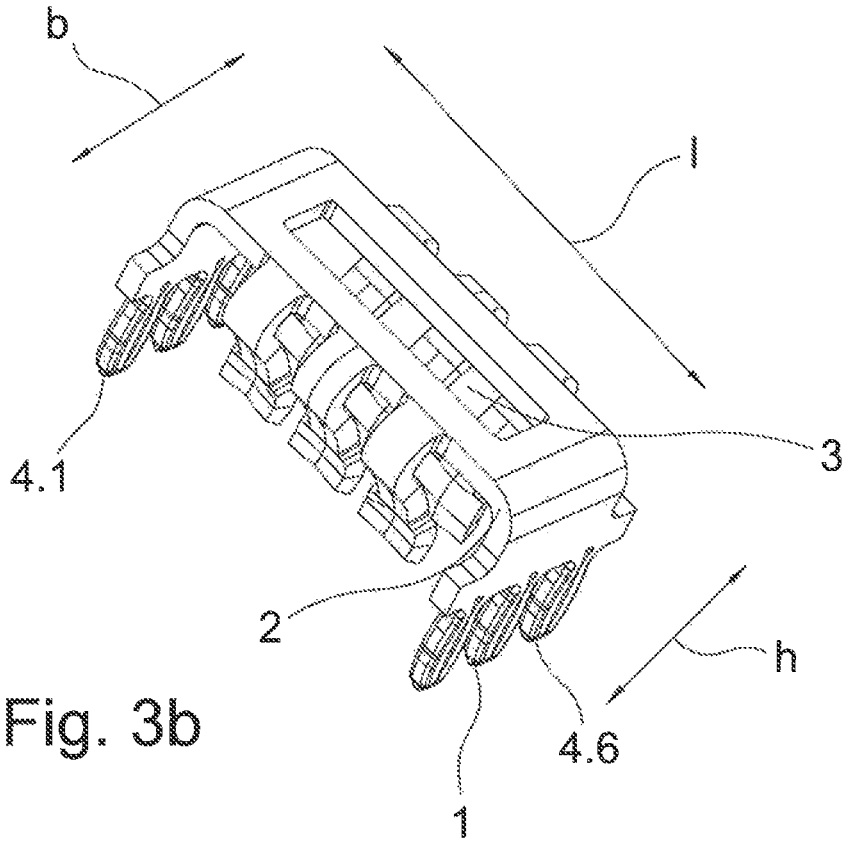
FIG. 3*b* shows an electronic contact according to FIG. 1 produced from a leadframe according to FIG. 3*a* in a schematic, perspective illustration seen from the front in actual size.
Figure 3C:
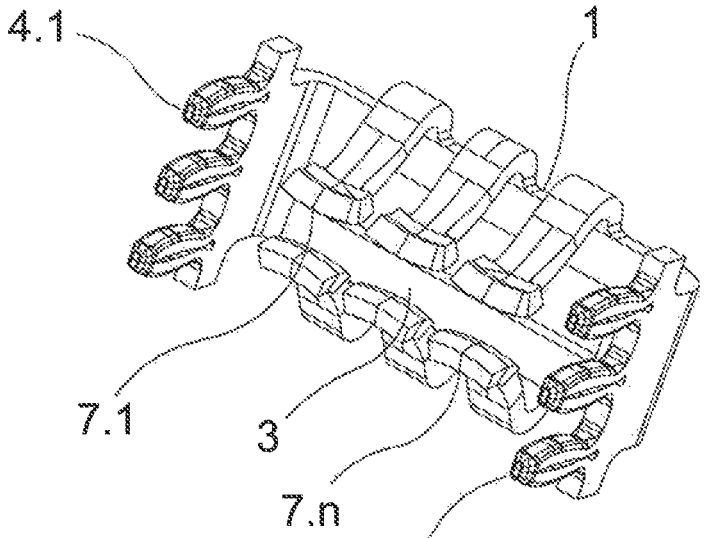
FIG. 3*c* shows an electronic contact as in FIG. 1 produced from a leadframe according to FIG. 3*a* in a schematic, perspective illustration seen from above in actual size.

FIGS. 1, 3*b* and 3*c* illustrate an electronic contact 1. It has a contact plate 2 having a contact recess 3. The contact plate 2 and the contact recess 3 have a rectangular cross section.

A side plate 5 is bent at a right angle on a narrow side of the contact plate 2. The side plate 5 transitions into a wider crossbeam 8. Three press-in contacts 4.1, 4.2, 4.3 are arranged on the crossbeam 8.

A side plate 6 is bent at a right angle on the other narrow side of the contact plate 2. The side plate 6 likewise transitions into a wider crossbeam 9. Three press-in contacts 4.4, 4.5, 4.6 are likewise arranged on the crossbeam 9.

A press-in contact such as any of 4.1-4.6 is known per se, and consists of at least a contact body and two opposing limb elements that have a connection region, a press-in region and a contact tip, wherein the contact body and the limb elements arranged thereon are formed integrally, wherein the limb elements are formed in a manner designed so as to be curved, and wherein the limb elements designed so as to be curved are arranged with the free contact tips opposite one another at least partly in contact and so as to form the press-in region.

The number of press-in contacts 4.1-4.6 on the crossbeam is in each case not just restricted to three. There may be more or even fewer.

The press-in contacts 4.1-4.6 may not just be oriented perpendicularly upward, as illustrated. Rather, they may be angled in any direction, that is to say point to the side, inward, downward or the like.

Furthermore, the press-in contacts 4.1-4.6 may have different lengths and diameters.

Instead of the press-in contacts 4.1-4.6, solder contacts may also be used.

Three clamping contacts 7.1, 7.2, 7.3 are arranged on a longitudinal side of the contact plate 2. Three further clamping contacts 7.4, 7.5, 7.6 are arranged on the opposing longitudinal side of the contact plate 2. The clamping contacts 7.1-7.6 are arranged so as to be spaced apart from one another, preferably evenly, on both sides of the connection recess 3, and so as to be distributed over the length of the connection recess.

Each clamping contact 7.1-7.6, starting from the contact plate 2, is bent substantially in an S-shape toward the connection recess 3. In this case, starting from the contact plate, a circular arc of the clamping contact 7.1-7.6 is formed firstly outwardly and then inwardly toward the recess 3, so as then to transition into the last arc with a substantially upright end. The outwardly transitioning circular arc is in this case responsible for the elastic pressing force, whereas the last arc with the substantially upright end forms the contact surface.

Figure 2:
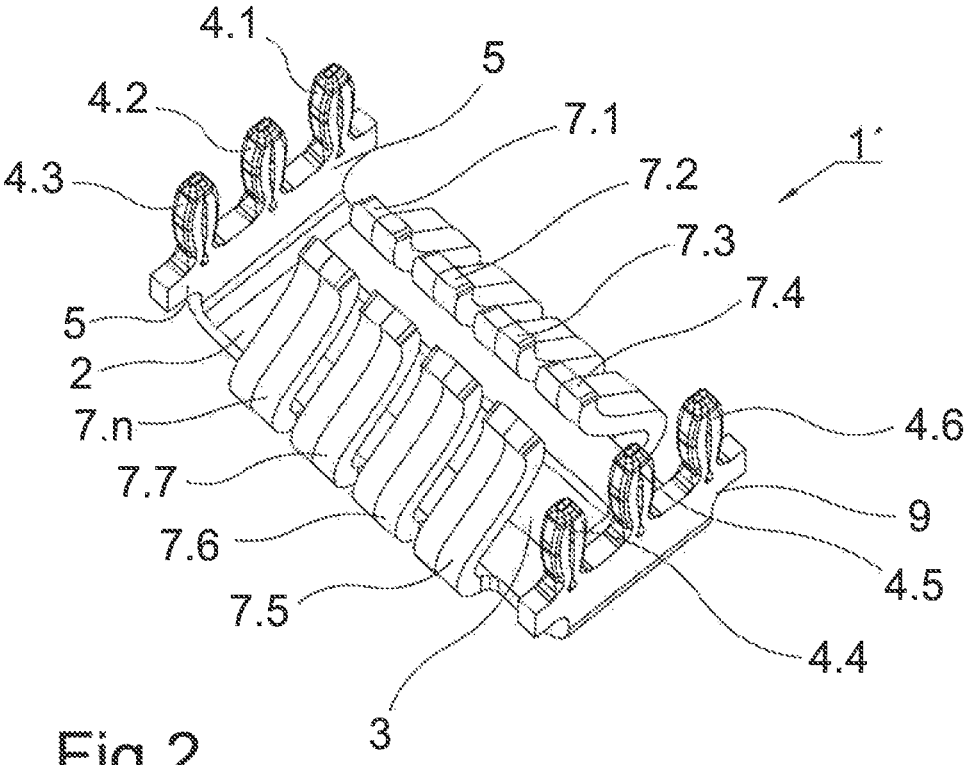
FIG. 2 shows a second embodiment of an electronic contact according to FIG. 1 in a schematic, perspective illustration seen from below.

FIG. 2 illustrates an electronic contact 1'. In principle, it is constructed similarly to the contact 2 and differs in terms of the number of clamping contacts. For this reason, identical reference elements are used for identical elements.

It likewise has a contact plate 2 having a contact recess 3. However, the contact recess 3 is longer. The contact plate 2 and the longer contact recess 3 have a rectangular cross section, the side plate 5, which transitions into a wider crossbeam 8, being bent at a right angle on a narrow side of the contact plate 2. Three press-in contacts 4.1, 4.2, 4.3 are also arranged on the crossbeam 8 here.

The side plate 6 is also bent at a right angle on the other narrow side of the contact plate 2 here. The side plate 6 likewise transitions into the wider crossbeam 9. Three press-in contacts 4.4, 4.5, 4.6 are likewise arranged on the crossbeam 9.

In contrast to the contact 1, four clamping contacts 7.1, 7.2, 7.3, 7.4 are arranged on a longitudinal side of the contact plate 2 here. Four further clamping contacts 7.5, 7.6, 7.7, . . . 7.*n* are likewise arranged on the opposing longitudinal side of the contact plate 2.

The clamping contacts 7.1-7.*n* are arranged on both sides of the connection recess 3, and so as to be distributed over the length thereof.

The number of clamping contacts 7.1 may be paired, that is to say an equal number of clamping contacts on both sides of the connection recess, also be 5 to 5 or 6 to 6 and more, as is intended to be expressed by the number up to 7.*n*.

Fewer contact pairs may also be used. The number of clamping contacts may furthermore also be different on both sides (unpaired arrangement).

Each clamping contact 7.1-7.*n* starting from the contact plate 2, is also bent substantially in an S-shape toward the connection recess 3 here.

The production of the electronic contact 1 will be explained with reference to FIGS. 1, 3*a*, 3*b* and 3*c*:

A) introducing a metal foil, for example made from CuNiSi, having a thickness of for example between 0.4 and 2.5 mm;

B) punching out leadframes 10 having
a leadframe height H, a plate element 256 having a contact recess 3, at least one press-in contact blank, and forming the blank so as to form press-in contacts 4.1-4.6, and at least one contact tab;

C) forming and folding the plate element 256 of a respective side plate 5, 6 by approximately 90° from a contact plate 2 that contains the contact recess 3.

In this case, the dimensions may be for example:

| | |
|---|---|
| leadframe height | H = 45.1 mm, |
| contact length | l = 23.8 mm, |
| contact width | b = 12.8 mm |
| contact height | h = 10.1 mm |

The individual production steps make it clear that the forming procedures that are decisive in terms of production, such as punching and forming procedures, are able to be executed in one plane. The tools that are necessary are able to operate substantially vertically downward and exert high forces.

All that are left are essentially straightening procedures in order to bend the connection contacts 4.1-4.6 and the clamping contacts **7.1-7.*n*** into the desired upright position and shape.

A finger-sized, compact contact having very small dimensions for very high currents is created. The currents may be up to 1500 A and more, depending on the material thickness.

The entire production is quite significantly simplified. This substantially easier production furthermore makes it possible to increase the metal sheet thickness, as already explained at the outset. The metal sheet thickness has now been increased to 1.5 mm. It is also possible to increase the metal sheet thickness even more. A thickness of up to 2.5 mm is conceivable, that is to say double the thickness of 1.2 mm previously able to be processed, with approximately identical dimensions for the contact length 1, contact width b and contact height h of the electronic contact. The high-current application is furthermore quite significantly improved.

Figure 7:
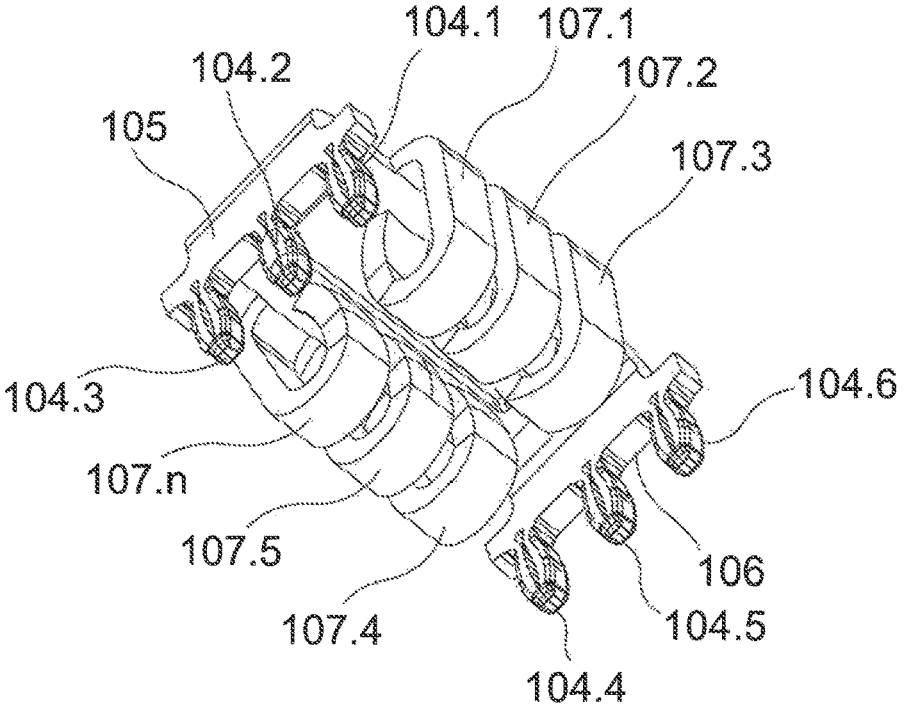
FIG. 7 shows an electronic contact according to FIG. 6 in a schematic, perspective illustration seen from the side and below.
Figure 8:
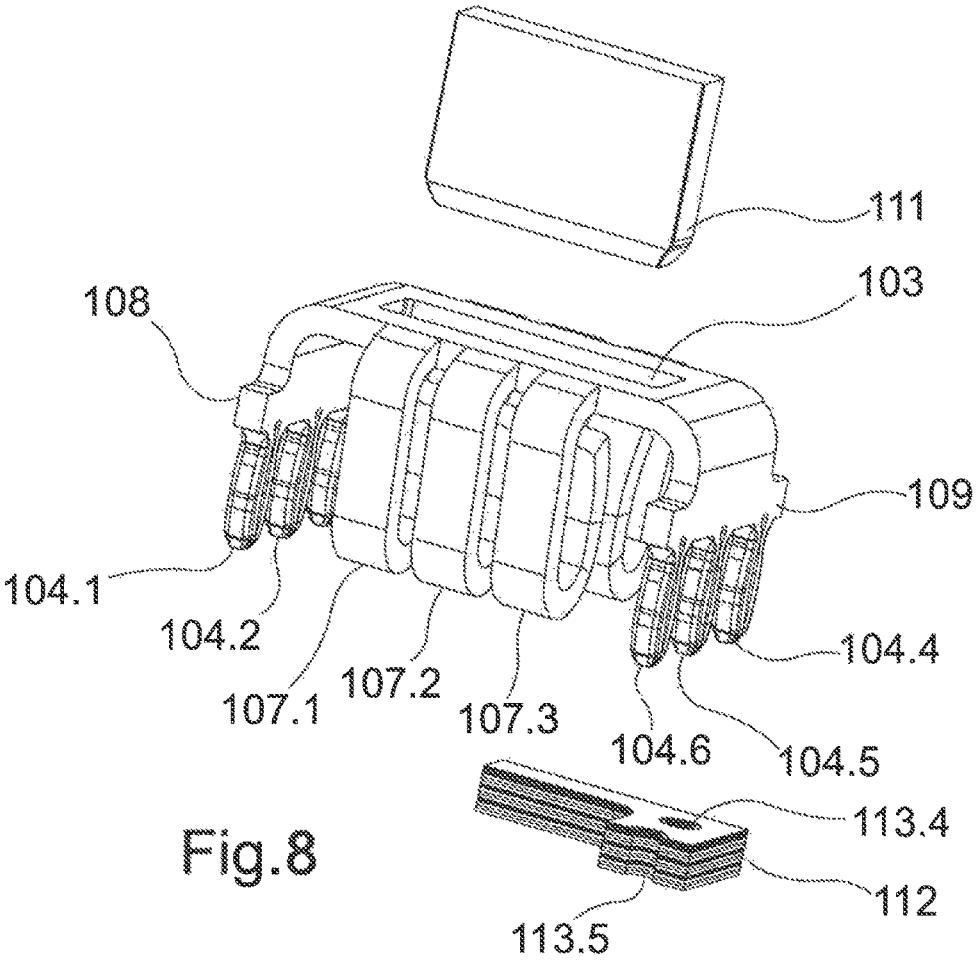
FIG. 8 shows a third exemplary embodiment of a circuit board connection device having an electronic contact according to FIG. 7 seen from above, a third plug contact and a third circuit board in a schematic, perspective, partly sectional illustration.

FIGS. 7 and 8 illustrate an electronic contact 101. It is similar to the contact 1 according to FIG. 1 that has already been described.

From a substantially rectangular contact plate 102 having a rectangular recess 103, opposing side plates 105, 106 are arranged in a manner raised at an angle of approximately 90° on the narrow sides. The side plates transition into cross-beams 108, 109 on which connection contacts are arranged, which are designed as groups of in each case three press-in contacts 104.1, 104.2, 104.3 and 104.4, 104.5, 104.6.

Three clamping contacts 107.1, 107.2, 107.3 are arranged on a longitudinal side of the contact plate 102. Three further clamping contacts 107.4, 107.5, 107.6 are arranged on the opposing longitudinal side of the contact plate 102.

In this case too, preferably 1 pair to n pairs of clamping contacts, that is to say 2, 4, 6, 8, etc., may be opposite one another at the recess 103. Unpaired contact arrangements may also be implemented, depending on the application.

The clamping contacts 107.1-107.6 extend over both sides of the connection recess 103, and over the length thereof.

Each clamping contact 107.1-107.6, starting from the contact plate 2, is bent substantially as an open 6 toward the connection recess 103. In this case, the clamping contact is bent in an arc from the contact plate so as then to transition into a perpendicular straight part. Following this, there is bending by 180° over a curve so as to be angled slightly inward at the end.

As a result, clamping contacts 107.1-107.6 have elastic properties and thus press fixedly against a plug-in contact 111. In addition, they have releasing properties, in contrast to the clamping contacts **7.1-7.*n***. That is to say, the plug contact may be plugged in and pulled out as often as desired.

Figure 4:
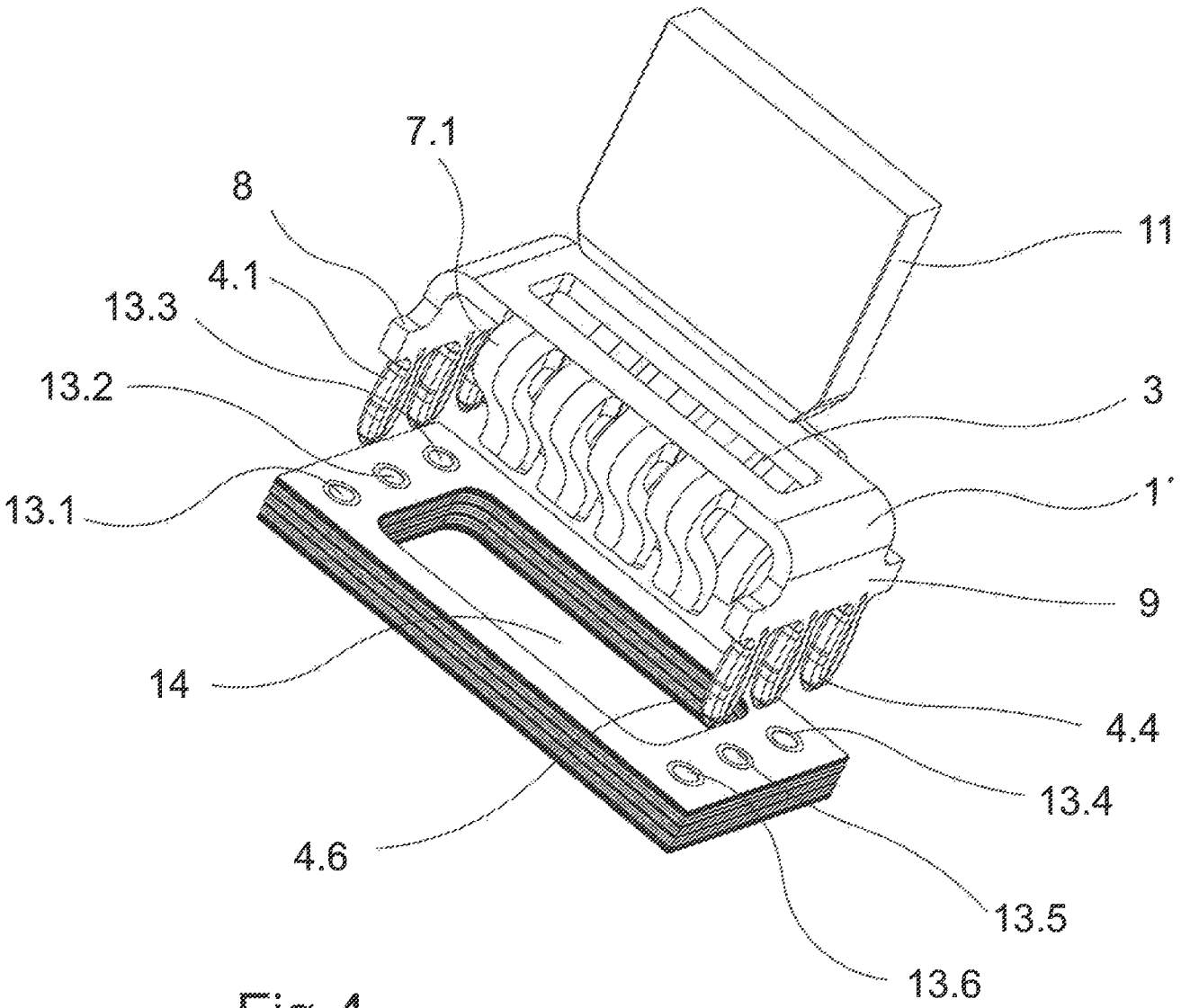
FIG. 4 shows an exemplary embodiment of a circuit board connection device having an electronic contact according to FIG. 2 seen from above, a plug contact and a circuit board in a schematic, perspective illustration.

The formation of a first circuit board connection device using the electronic contact 1' illustrated and described in FIG. 2 is described below with reference to FIG. 4:

The circuit board connection device consists of a plug contact 11, an electronic contact 1' and a circuit board element 12.

The circuit board element 12 has a substantially rectangular circuit board recess 14 and circuit board connection recesses 13.3, 13.4, 13.5 and 13.6.

For connection to the circuit board element 12, the electronic contact 1' is pressed into the circuit board connection recesses with the press-in contacts 4.1, . . . . The crossbeams 8 and 9 could in this case sit on the circuit board element 12, and the clamping contacts could protrude into the circuit board recess 14. The plug contact 11 is then pushed through the contact recess 3 into the clamping contacts 7.1-7.8, and the electrical connection is produced.

The clamping contacts 7.1-7.8 are designed such that they make it difficult to pull out the plug contact.

The electronic contact 1' may be partly or substantially completely enclosed by a housing (not illustrated). Said housing consists of plastic or the like and leaves the press-in contacts 4.1-4.6 and the clamping contacts **7.1-7.*n* partly free. An approximately identically sized opening is provided for the recess 3**. The opening may be also be delimited by notches, perforations or the like, such that, when the plug contact is inserted, said opening is pressed out of the foil.

Figure 5:
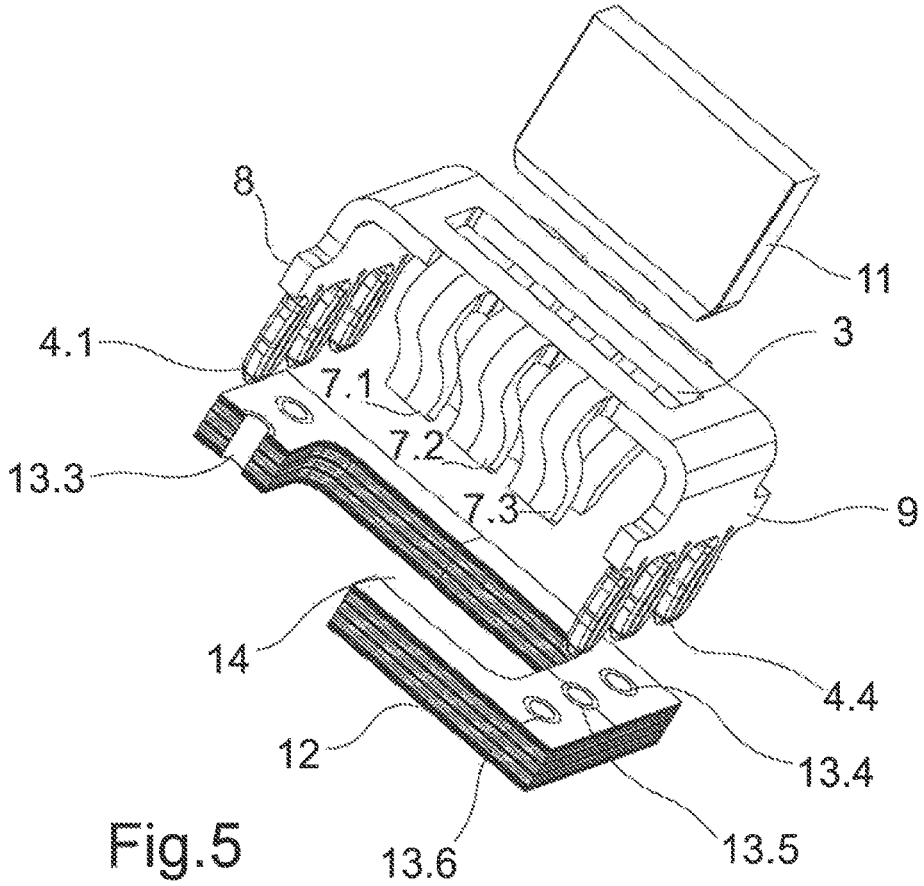
FIG. 5 shows a further exemplary embodiment of a circuit board connection device having an electronic contact according to FIG. 1 seen from above, a further plug contact and a further circuit board in a schematic, perspective, partly sectional illustration.

The formation of a second circuit board connection device using the electronic contact 1 illustrated and described in FIGS. 1, **3*b* and 3*c* is described below with reference to FIG. 5**:

In this case too, the circuit board connection device consists of a plug contact 11, an electronic contact 1 and a circuit board element 12.

The electronic contact 1 has for example two sets of three clamping contacts 7.1, 7.2, 7.3 and 7.4, 7.5, 7.6.

The circuit board element 12 also has a substantially rectangular circuit board recess 14 and circuit board connection recesses 13.1, 13.2, 13.3, 13.4, 13.5 and 13.6 here.

For connection to the circuit board element 12, the electronic contact 1 is pressed into the circuit board connection recesses with the press-in contacts 4.1-4.6 and the two sets of three clamping contacts 7.1, 7.2, 7.3 and 7.4, 7.5, 7.6 are guided into the circuit board recess 14.

The plug contact 11 is then plugged into the clamping contacts and a secure electrical connection is produced, the clamping contacts acting as already described. In this case too, the electronic contact 1 may be housed as in the case of the electronic contact 1'.

Figure 6:
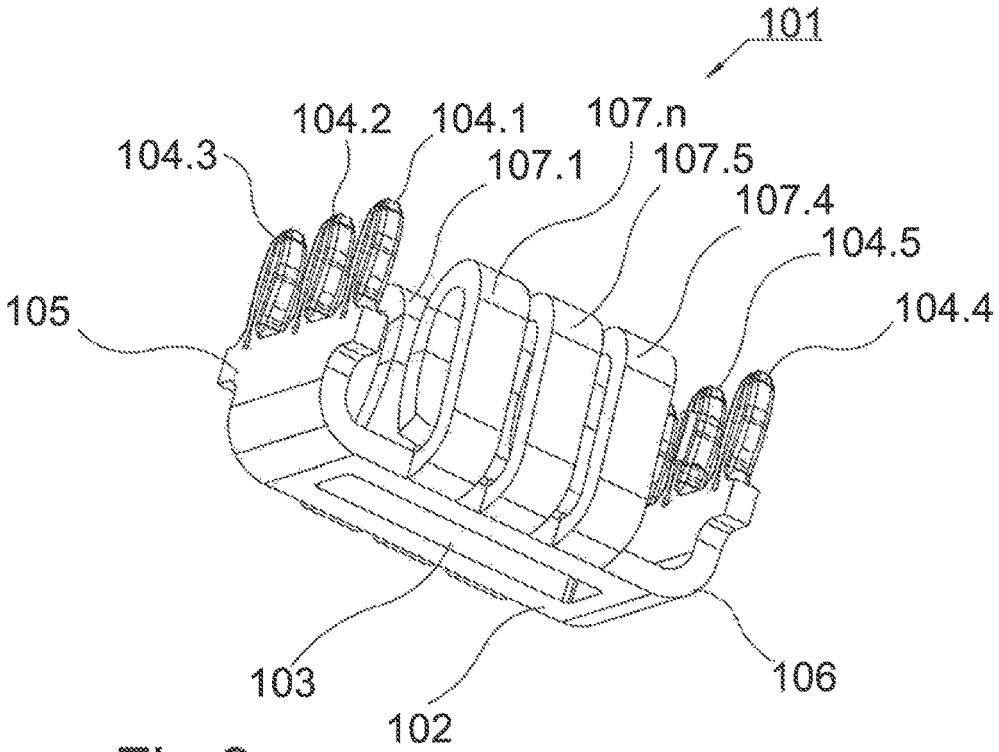
FIG. 6 shows a further exemplary embodiment of an electronic contact in a schematic, perspective illustration seen from the side.

The formation of a third circuit board connection device using the electronic contact 101 illustrated and described in FIGS. 6 and 7 is described below with reference to FIG. 8:

The circuit board connection device consists here of a plug contact 111, an electronic contact 101 and a circuit board element 112.

The circuit board element, only partly illustrated, exhibits a substantially rectangular circuit board recess 114 and circuit board connection recesses 113.4, 113.5.

For connection to the circuit board element 112, the electronic contact 111 is pressed into the circuit board connection recesses with the press-in contacts 104.1-104.6. The crossbeams 108, 109 may in this case sit on the circuit board element 112, and the clamping contacts protrude into the circuit board recess 114.

The plug contact 111 is then pushed through the contact recess 103 into the clamping contacts 107.1-107.6, and the electrical connection is produced.

The clamping contacts 107.1-107.8 are thus designed so as to be substantially in the shape of a 6, and have the effect that they facilitate both insertion and pulling out of the plug contact 111. A releasable electrical connection is thereby formed.

The electronic contact 101 may also be partly enclosed by a housing (not illustrated) here. Said housing may consist of plastic or the like and leaves the press-in contacts 104.1, . . . and the clamping contacts 107.1-107.8 partly free. An approximately identical opening may be provided for the recess 103. The opening may also be delimited by notches or the like here, such that for example, unlike illustrated, when the plug contact is inserted from the other side, the foil is pressed out.

The invention claimed is:

1. A contact device having at least:

a plurality of connection contacts, a contact clamping apparatus, and a contact reception apparatus, wherein:

the contact reception apparatus is designed as a substantially rectangular contact plate into which a contact recess is introduced, the contact plate comprising two longitudinal sides and two end sides;

two side plates comprising the connection contacts are arranged on both end sides of the contact plate, and the contact clamping apparatus comprises a plurality of clamping elements provided at both longitudinal sides of the contact plate.

2. The device as claimed in claim 1, wherein the contact plate, the side plates having the connection contacts, and the clamping elements are produced from a metal sheet, from an electrically conductive material with a thickness of between 0.4 and 1.5 mm.

3. The device as claimed in claim 1, wherein the contact plate, the side plates having the connection contacts, and the clamping elements are at least partly enclosed by a housing.

4. The device as claimed in claim 2, wherein the metal sheet consists of copper, brass, aluminum or CuNi Si.

5. The device as claimed in claim 1, wherein the clamping elements are designed so as to be substantially S-shaped.

6. The device as claimed in claim 1, wherein the clamping elements are designed so as to be substantially 6-shaped.

7. The device as claimed in claim 1, wherein the connection contacts are designed as press-in contacts or solder contacts.

8. A circuit board connection device having a contact device as claimed in claim 1 and a plug contact, wherein the plug contact is guided through the contact reception apparatus and held in the contact clamping apparatus and the connection contacts are able to be connected to a circuit board element.

9. A method for producing a contact device as claimed in claim 1, having the steps:

providing a metal foil;

punching out the metal foil so as to form a substantially rectangular plate element having two longitudinal sides, two end sides, a contact recess, at least one press-in contact blank at both end sides, and a plurality of contact clamping elements at the longitudinal sides;

forming the at least one press-in contact blank so as to form at least one connection contact;

bending the plate element so as to form a respective side plate, and bending the plurality of contact clamping elements.

* * * * *